US011268544B2

(12) United States Patent
Bruck et al.

(10) Patent No.: US 11,268,544 B2
(45) Date of Patent: Mar. 8, 2022

(54) PRESSURE COMPENSATOR VALVE

(71) Applicant: HYDAC FLUIDTECHNIK GMBH, Sulzbach/Saar (DE)

(72) Inventors: Peter Bruck, Althornbach (DE); Frank Schulz, Blieskastel-Bierbach (DE)

(73) Assignee: HYDAC FLUIDTECHNIK GMBH, Sulzbach/Saar (DE)

( * ) Notice: Subject to any disclaimer, the term of this patent is extended or adjusted under 35 U.S.C. 154(b) by 132 days.

(21) Appl. No.: 16/643,892

(22) PCT Filed: Sep. 5, 2018

(86) PCT No.: PCT/EP2018/073823
§ 371 (c)(1),
(2) Date: Jun. 16, 2020

(87) PCT Pub. No.: WO2019/048455
PCT Pub. Date: Mar. 14, 2019

(65) Prior Publication Data

US 2020/0347855 A1 Nov. 5, 2020

(30) Foreign Application Priority Data

Sep. 6, 2017 (DE) ..... 10 2017 008 359.2

(51) Int. Cl.
*F15B 13/04* (2006.01)
*B66F 9/22* (2006.01)
(Continued)

(52) U.S. Cl.
CPC ..... *F15B 13/0417* (2013.01); *B66F 9/22* (2013.01); *F15B 11/05* (2013.01);
(Continued)

(58) Field of Classification Search
CPC .. F15B 11/05; F15B 2013/004; F15B 13/026; F15B 1/021; F15B 1/027; B66F 9/22
See application file for complete search history.

(56) References Cited

U.S. PATENT DOCUMENTS 6,786,132 B2 * 9/2004 Albert ..... B66F 9/22 60/406
7,841,360 B2 * 11/2010 Bruck ..... F16K 17/0473 137/625.68
(Continued)

FOREIGN PATENT DOCUMENTS

DE 3605980 10/1986
DE 41 40 409 6/1993
(Continued)

OTHER PUBLICATIONS

International Search Report dated Nov. 2, 2018 in International (PCT) Application No. PCT/EP2018/073823.

*Primary Examiner* — Thomas E Lazo
(74) *Attorney, Agent, or Firm* — Wenderoth, Lind & Ponack, L.L.P.

(57) ABSTRACT

A valve, in particular for use as a pressure compensator or maintenance-type component (38) in hydraulically actuated hoisting devices (2), has a valve housing (54) with a control port (40), a fluid inlet (64) and a fluid outlet (66). A regulating piston (68) is longitudinally displaceably in the valve housing (54) and acts against an energy storage device (70) in the form of a compression spring, bringing the regulating piston (68) into positions forming a fluid-conveying connection between the fluid inlet (40) and the fluid outlet (66) or blocking this connection by a control pressure existing at the control port (40). A first orifice (88) in the regulating piston (68) connects the control port (40) to a receiving space (62) for the energy storage device (70) in a fluid-conveying manner. A second orifice (90) is in an
(Continued)

intermediate part (72) in the valve housing (54). The receiving space (62) can be connected to a compensating chamber (92), which connected to the fluid outlet (66) in a fluid-conveying manner (98).

19 Claims, 4 Drawing Sheets

(51) Int. Cl.
*F15B 11/05* (2006.01)
*F15B 13/00* (2006.01)

(52) U.S. Cl.
CPC ..... *F15B 2013/004* (2013.01); *F15B 2211/50572* (2013.01); *F15B 2211/57* (2013.01); *F15B 2211/625* (2013.01); *F15B 2211/6658* (2013.01)

(56) References Cited

U.S. PATENT DOCUMENTS

| | | | | |
|---|---|---|---|---|
| 8,973,609 | B2 * | 3/2015 | Hilzendegen | F15B 11/05 137/625.6 |
| 9,677,575 | B2 * | 6/2017 | Hilzendegen | F15B 11/166 |
| 2008/0115848 | A1 | 5/2008 | Bruck et al. | |
| 2013/0287601 | A1 * | 10/2013 | Mori | E02F 9/2235 417/364 |

FOREIGN PATENT DOCUMENTS

| | | |
|---|---|---|
| DE | 102 02 607 | 7/2003 |
| EP | 2 698 545 | 2/2014 |
| EP | 3 309 644 | 4/2018 |
| WO | 2006/084576 | 8/2006 |

* cited by examiner

PRESSURE COMPENSATOR VALVE

FIELD OF THE INVENTION

The invention relates to a valve, in particular for use as a pressure compensator or pressure maintenance-type component in hydraulically actuated hoisting devices. A valve housing has a control port plus a fluid inlet and a fluid outlet. A regulating piston is longitudinally displaceably arranged in the valve housing. The regulating piston, against the action of an energy storage device, in particular in the form of a compression spring, brings the regulating piston into at least one position forming a fluid-conveying connection between the fluid inlet and the fluid outlet or blocks this connection by a control pressure existing at the control port.

BACKGROUND OF THE INVENTION

The use of a pressure compensator in hydraulically operated hoisting devices is state of the art. DE 102 02 607 C1 discloses by way of example the arrangement of a pressure compensator for influencing the lowering behavior in a hoisting device for raising and lowering loads. The pressure compensator is arranged in a return line of a relevant lifting cylinder. Another preferred application is the use in hoisting devices, which are equipped with a hoist damper, which can be activated or deactivated. In this case, a pressure compensator is used to ensure that the accumulator pressure at an assigned damping accumulator automatically follows the load pressure of the relevant hoist cylinder both for an activated and deactivated hoist damper. This pressure compensator prevents any uncontrolled lifting or lowering of the hoist in the event the hoist damper is activated after a previous deactivated operation.

SUMMARY OF THE INVENTION

Based on this state of the art, the invention addresses the problem of providing a valve, which, as a pressure compensator for use in hydraulically operated hoisting devices equipped with hoist damping, is characterized by a particularly favorable operating behavior.

According to the invention, this object is basically achieved by a valve having, as an essential special feature of the invention, a first orifice arranged in the regulating piston, which connects the control port to a receiving space for the energy storage device in a fluid-conveying manner, and a second orifice arranged in an intermediate part inside the valve housing, by which orifices the receiving space can be connected to a compensating chamber, which is connected to the fluid outlet in a fluid-conveying manner. Owing to the arrangement of two orifices which, on the one hand, are routed from the control port to the receiving space holding the spring applying load on the regulating piston and, on the other hand, are routed from the compensating chamber bearing the pressure of the fluid outlet to the receiving space, the valve represents a kind of servo-controlled pressure compensator. The combination of the two orifices and the spring arranged therebetween amplifies the regulating pressure of the compensating piston generated by the spring. This arrangement is favorable for a compact design having a small-sized pressure spring in the manner of a cartridge valve, which is particularly suitable for use in hoisting devices of mobile units, such as forklifts, mobile cranes or the like, where the installation space for the hydraulic components is limited.

Due to the function of the pressure compensator, the pressure at the damping accumulator follows the load pressure at the lifting cylinder. The damping accumulator is automatically depressurized when the lifting cylinder is lowered and is repressurized when the lifting cylinder is raised again. The continuous pressurization process, which also occurs when the damping mode is deactivated, i.e. when the damping accumulator is inoperable, requires pump output, consuming energy and reducing the lifting speed. In the state of the art, an additional switching valve, which blocks this connection in deactivated damping mode and prevents the loading process of the accumulator in this mode, is inserted between the pump side and the pressure compensator or maintenance-type component, preventing this effect.

With regard to this problem, in a particularly advantageous exemplary embodiment of the design of the valve according to the invention, the second orifice can be closed by a servo-control device, which can be controlled by a solenoid. If a solenoid is used, the closing force of which is greater than the hydraulic force acting on the regulating piston, the servo oil is prevented from flowing when the solenoid is actuated. As a consequence, the regulating piston of the pressure compensator remains in the closed position, effectively blocking the pressure compensator. In this way, the locking function usually provided by the additional switching valve can be integrated into the cartridge of the pressure maintenance-type component, resulting in corresponding savings in design effort and installation space of the damping device.

In advantageous exemplary embodiments, the servo control device has a servo cone, which interacts with a valve seat on the intermediate part and on which two energy storage devices, in particular in the form of compression springs, act in and against the direction of action of the solenoid.

The arrangement can be advantageous in such a way that the compensating chamber is accommodated, at least partially, in the intermediate part, which establishes a fluid-conveying connection to a collecting chamber as a further part of the compensating chamber. The compensating chamber is permanently connected in a fluid-conveying manner to the fluid outlet in the valve housing via at least one fluid-conveying passage-way.

In advantageous exemplary embodiments, the actuating part of the solenoid is guided in a connecting part of the solenoid provided for connecting the solenoid to the valve housing. The connecting part, at least partially, accommodates one energy storage device of the servo control device and is connected to the intermediate part. The intermediate part and the connecting part are arranged stationarily on the valve housing.

In advantageous exemplary embodiments, the regulating piston, at least in the area of the control port and at least in the area, in which, at least partially, one of the energy storage devices is accommodated, is designed as a hollow piston. One orifice, designed as a screw-in piece, is inserted into the regulating piston. Both cavities are permanently connected to each other in a fluid-conveying manner. If the diaphragm is designed as a screw-in piece, identical regulating pistons can be fitted with different orifices to adapt them to the desired function.

The regulating piston can advantageous be equipped with a stop part on the side of the intermediate part. The stop part can be brought into contact with the valve housing and intermediate part, respectively, in the other stop positions, respectively.

For the design of the valve in the cartridge design, the arrangement can be such that the control port is inserted into the valve housing in the axial direction and such that the fluid inlet and the fluid outlet extend through the valve housing in the radial direction. The hollow piston in conjunction with the valve housing defines an annular space on the outer circumference, which annular space completely transverses the fluid outlet in the other stop position of the regulating piston.

The subject matter of the invention is also a device for attenuating the hoist for at least one hydraulic load, in particular in the form of a hydraulic power cylinder.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
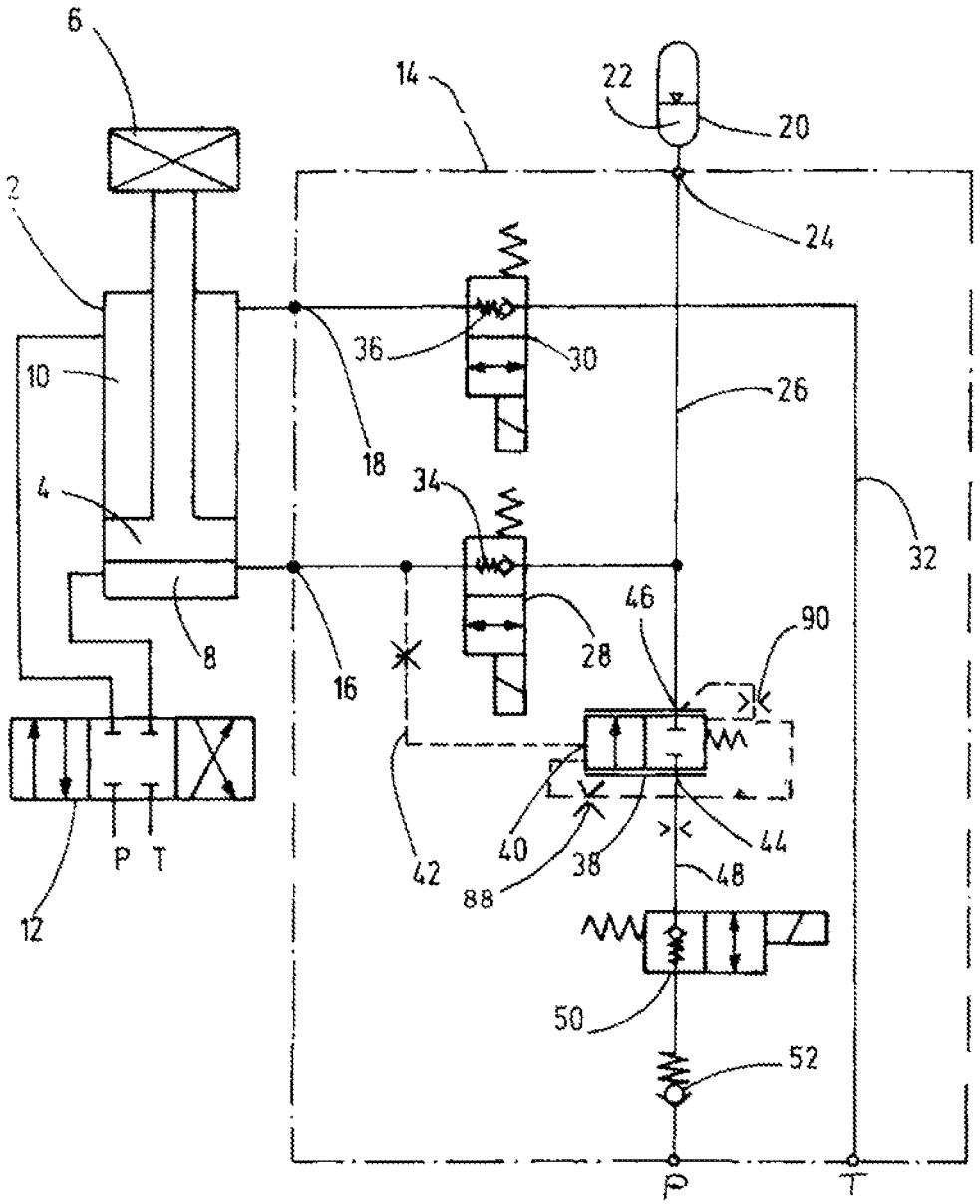
FIG. 1 is a schematic circuit diagram of a hydraulically actuated hoisting device provided with hoist damping according to a first exemplary embodiment of the invention.

In FIG. 1, a hydraulically actuated lifting cylinder 2 has a working piston 4 that can be used to raise and lower a load 6. To control the lifting cylinder 2, its working chambers 8 and 10, separated by the working piston 4, are connected to a 4/3-way spool valve 12, which can be controlled by a relevant operator and which has a pressure supply port P and a tank port T routed to the tank side. The hoisting device is equipped with a hoist damper 14, which is connected to the piston-side working chamber 8 via a connection point 16 and to the rod-side working chamber 10 of the lifting cylinder 2 via a connection point 18. In accordance with the state of the art, the hoist damper 14 has a hydropneumatic damping accumulator 20, the oil side 22 of which is connected to an accumulator line 26 at a connection point 24.

To bring the hoisting device into an operating state in which the hoist damper 14 is deactivated or into an operating state in which the hoist damper 14 is activated, two electrically actuated switching valves 28 and 30 are provided, which switching valves can be switched against a mechanical restoring force into a pass-through position to activate the hoist damper 14. In the pass-through position, the first switching valve 28 connects the piston-side working chamber 8 of the lifting cylinder 2 to the accumulator line 26 via the connection point 16. In the open position, the other or second switching valve 30 connects the rod-side working chamber 10 of the lifting cylinder 2 to a return line 32 routed to tank side T. In FIG. 1, which shows the state of the deactivated hoist damper 14, in the absence of electrical actuation, the switching valves 28 and 30 are in a switching position, in which the switching valve 28 uses a non-return valve 34 to block the fluid from flowing from the working chamber 8 to the accumulator line 26, but permits the fluid to flow in the opposite direction from accumulator 20 to the piston-side working chamber 8. In this switching position, the other switching valve 30 uses a non-return valve 36 to block the fluid flow from the rod-side working chamber 10 of the stroke cylinder 2 to the return line 32, but permits the fluid to flow in the opposite direction from the rod-side working chamber 10 to return line 32.

In the manner typically used for hoist damping, a pressure compensator or maintenance-type component 38 is inserted between the accumulator line 26 and the pressure supply port P. The control port 40 of pressure compensator 38 is connected to the port 16 via a control line 42, which is connected to the piston-side working chamber 8 of the lifting cylinder 2. The load pressure of the working chamber 8 of the lifting cylinder 2 therefore pressurizes the control port 40 via the control line 42. Because the fluid inlet or fluid inlet port 44 of the pressure compensator 38 is connected to the pressure supply port P via a load line 48 and the fluid outlet or fluid outlet port 46 is connected to the accumulator line 26, the accumulator pressure of the damping accumulator 20 follows the load pressure of the working chamber 8 of the lifting cylinder 2.

When operating the hoisting device at deactivated hoist damper 14, the piston-side working chamber 8 of the lifting cylinder 2 is connected to the tank side T via the 4/3-way valve 12 during lowering operations. For the switching position of the switching valve 28 shown in FIG. 1, therefore an unloading process of the damping accumulator 20 takes place via the non-return valve 34 of switching valve 28 during every lowering operation. As due to the function of the pressure compensator 38, the pressure of the damping accumulator 20 follows the load pressure in the working chamber 8 of the pressure cylinder 2, a new loading process of the damping accumulator 20 takes place via the loading line 48 with every new lifting process. To avoid successive loading processes of the damping accumulator 20 during successive lowering and lifting processes of the lifting cylinder 2 for a deactivated hoist damper 14, in the state of the art a switching valve 50 is inserted in the loading line 48 between pressure compensator 38 and pressure supply connection P, which prevents a loading flow in the direction of the damping accumulator 20 when the hoist damper 14 is deactivated and only opens the loading line 48 when the hoist damper 14 is activated. In addition, the loading line 48 is protected against reverse flow in the direction of the pressure supply port P by a check valve 52. The orifice or throttle in the control line 42 shown in FIG. 1 and the orifice or throttle in the loading line 48 (each without reference mark) are used to improve control and fine tuning of the hydraulic circuit (also FIG. 3).

Figure 2:
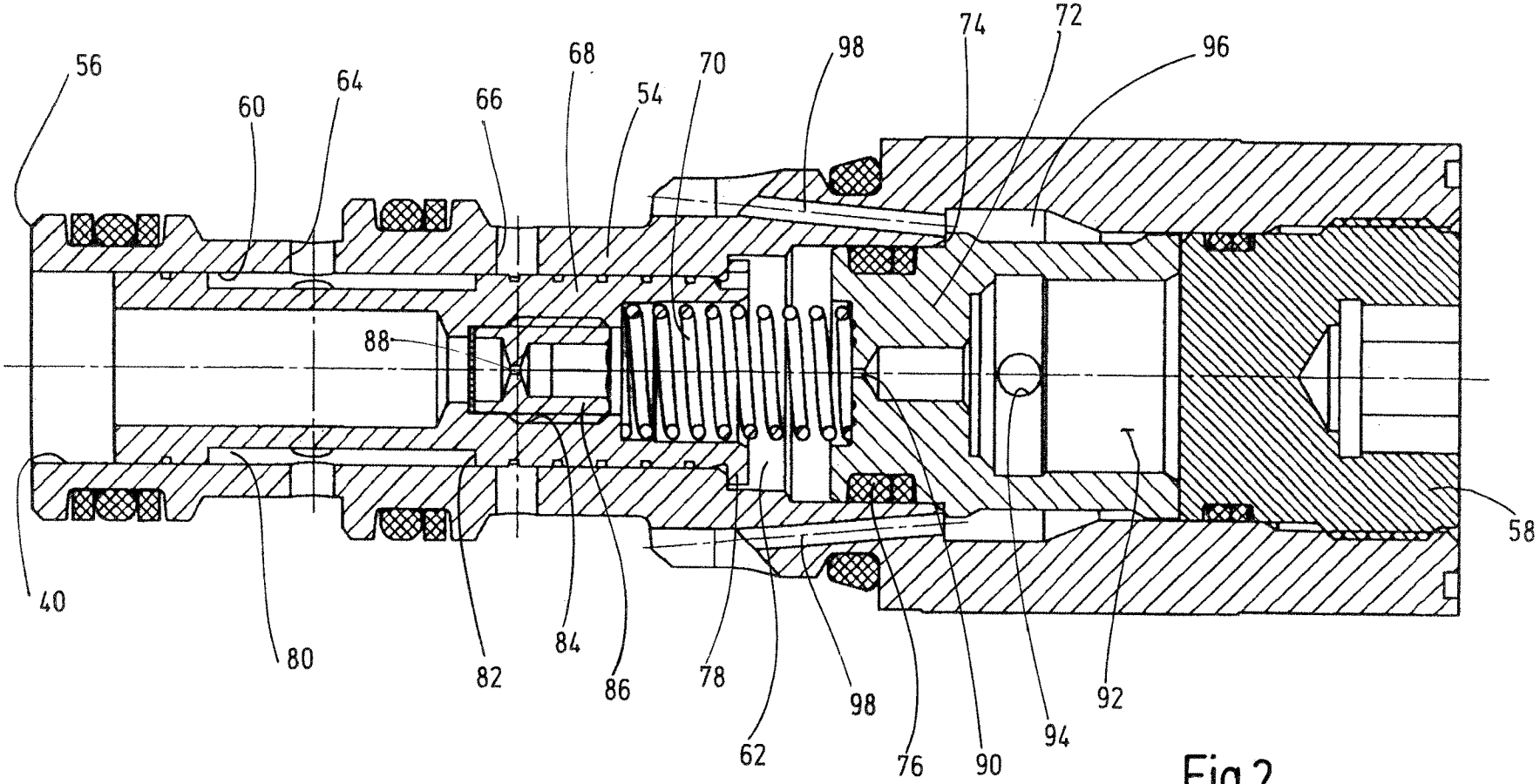
FIG. 2 is a side view in section of a design example, drawn approximately 3½ times enlarged compared to an exemplary embodiment of the valve in accordance with the invention, which is used as a pressure compensator in the hoisting device of FIG. 1.

FIG. 2 shows in a separate illustration the design of the pressure maintenance-type component 38 according to a first exemplary embodiment of the invention. The valve 38, built in the cartridge design, has a valve housing 54 having an open end 56 and a closed end sealed in a pressure-tight manner by a screwed-in end piece 58. The left housing section of the valve housing 54 can, in the manner typical for cartridges, as shown in FIG. 2, be installed in a valve block not shown. A guide cylinder 60 extends in the valve housing 54 from the open end 56 to a spring receiving chamber 62 having an enlarged inner diameter. In the area of the guide cylinder 60, the valve housing 54 has axially offset drilled holes 64 and 66, which form the access to the guide cylinder 60. The drilled holes 64 nearest to the open end 56 form the fluid inlet 44 (FIG. 1). The other drilled holes 66 form the fluid outlet 46 (FIG. 1). The open housing end 56 forms the control port 40 of the valve.

A regulating piston 68 is guided in the guide cylinder 60 for longitudinal movement, which regulating piston is designed as a hollow piston and is loaded at its inner end by a compression spring 70 provided as an energy storage device. The end of the compression spring 70 facing away from the regulating piston 68 is supported on an intermediate part 72, which is immobilized in the axial direction on the one hand by resting against a protrusion 74 of the valve housing 54 and on the other hand by resting against the end piece 58 and which seals the spring receiving chamber 62 by a sealing device or seal 76.

In the unpressurized state shown in FIG. 2, the compression 70 spring moves the regulating piston 68 into an end position, in which an end stop part 78 of the regulating piston 68 rests against a housing protrusion located at the end of the spring receiving chamber 62. In the other end position, displaced against the force of the compression spring 70, the stop part 78 of the regulating piston 68 rests against the intermediate part 72. The regulating piston 68 has an outer annular space 80 into which the fluid inlet or fluid inlet port 44 formed by the drilled holes 64 opens and whose axially inner end forms a control edge 82. In the unpressurized state shown in FIG. 2, the control edge 82 is located in front of the drilled holes 66 at the end position of the regulating piston 68 shown, closing the fluid outlet or fluid outlet port 46. When the regulating positions of the regulating piston 68 are displaced against the force of the compression spring 70, the control edge 82 exposes the connection to the annular space 80. The control edge 82 completely passes over the drilled holes 66 of the fluid outlet 46 when the regulating piston 68 is moved to the right end position.

In the area adjacent to the spring receiving chamber 62, the regulating piston 68, which is designed as a hollow piston, has an area having a tapered inner diameter and a female thread 84, into which a screw-in piece 86 is screwed. In piece 86, a first orifice 88 or throttle is located, which connects the control input 40 to the spring receiving chamber 62. A second orifice or throttle 90 is formed in the intermediate part 72 adjacent to the spring receiving chamber 62, which connects the spring receiving chamber 62 to a compensating chamber 92 located in the intermediate part 72. In turn, compensating chamber 92 is connected to a collecting chamber 96, which is located as an annular space between the outer circumference of the intermediate part 72 and the inside of the valve housing 54, via radial drilled holes 94. Inclined passage-ways 98 in the valve housing 54 are used to connect the collecting chamber 96 to the fluid outlet 46 formed by the drilled holes 66 via fluid guides in the valve block (not shown). The pressure of the damping accumulator 20 is then effective at the second diaphragm 90 via the passageways 98, the compensating chamber 96 and the compensating chamber 92. The combination of the two orifices 88 and 90 and the pressure spring 70 located in between forms a kind of servo control for the pressure compensator. The servo oil flow flowing through the second diaphragm 90 amplifies the regulating pressure generated by the pressure spring 70.

Figure 3:
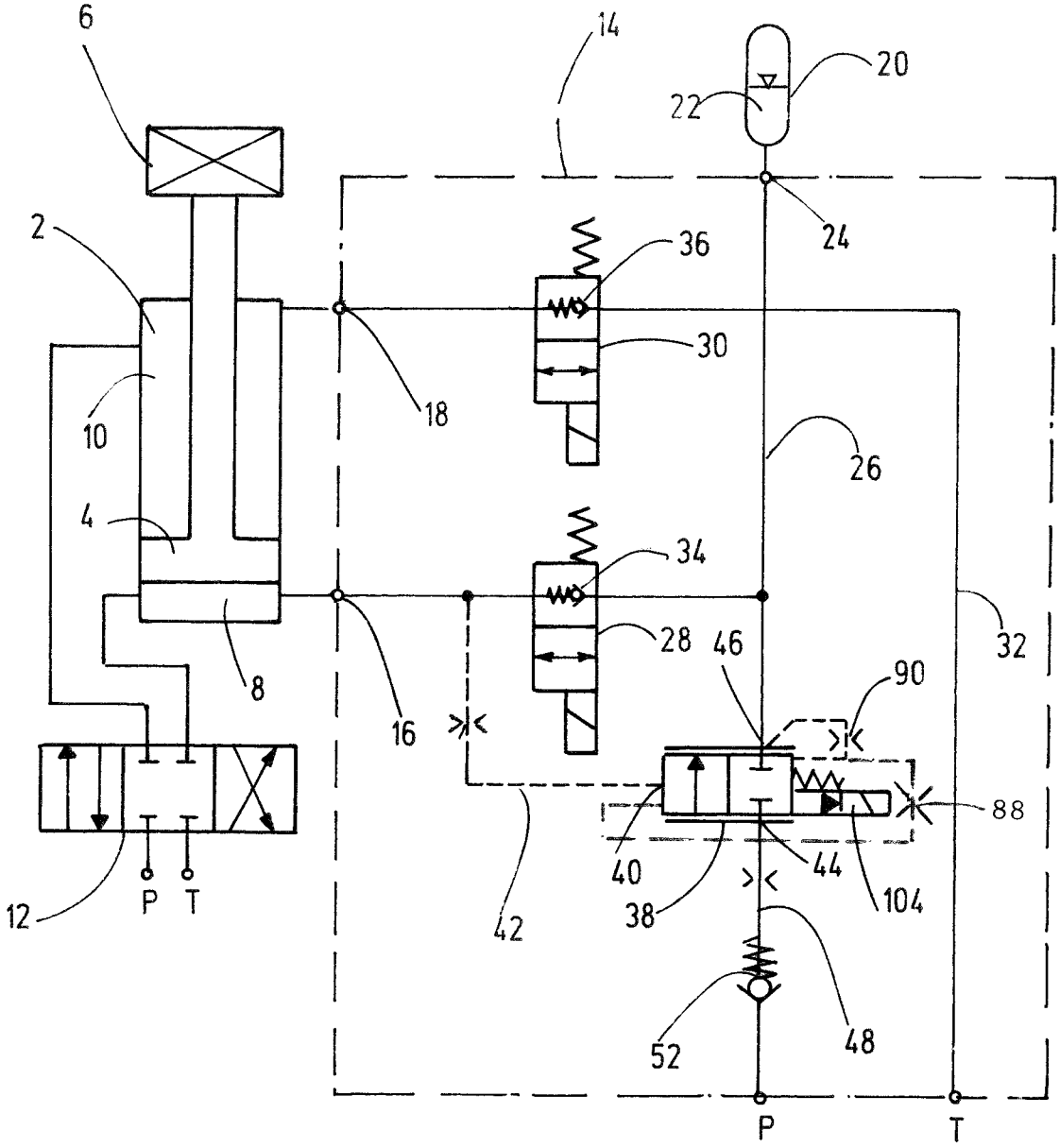
FIG. 3 is a schematic circuit diagram of a hydraulically actuated hoisting device provided with hoist damping, which has a valve as a pressure compensator or maintenance-type component according to a second exemplary embodiment of the invention.
Figure 4:
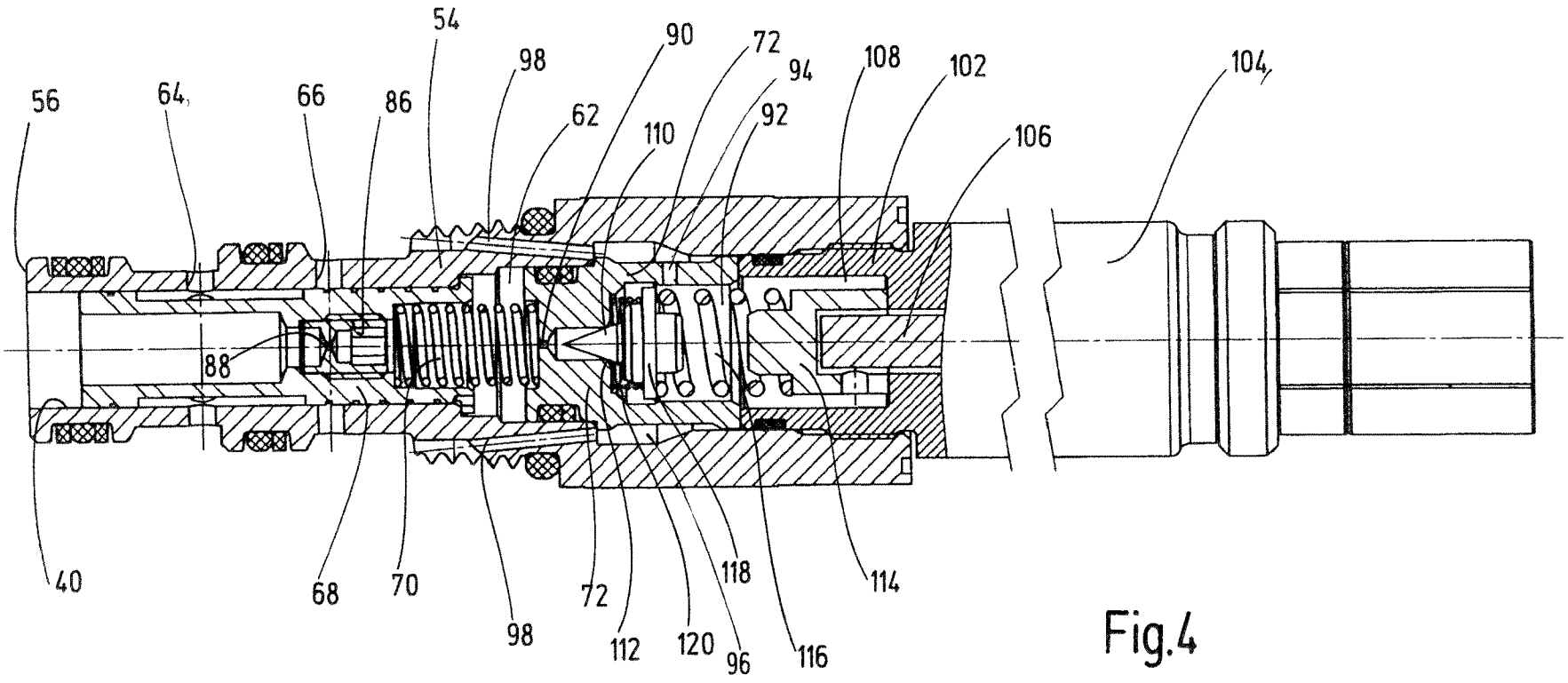
FIG. 4 is a side view in section of a design example of the valve according to the second exemplary embodiment of the invention.

FIG. 3 shows, like FIG. 1, the circuit of a hydraulically operated hoisting device, wherein the hoist damper 14 is based on a pressure compensator or maintenance-type component according to a second exemplary embodiment of the valve according to the invention, which valve is shown separately in longitudinal section in FIG. 4. The design of the valve housing 54 of the second exemplary embodiment corresponds to the first exemplary embodiment, as do the internal components, such as the regulating piston 54 including the first diaphragm 88, the compression spring 70, the intermediate part 72 as the end of the spring receiving chamber 62 and the second diaphragm 90. In contrast to the first exemplary embodiment, the compensating chamber 92 formed in the intermediate part 72 is not closed by a closed end piece 58, but is replaced by a connecting part 102 screwed into the valve housing 54 for an actuating solenoid 104. Like the end piece 58 of the first exemplary embodiment, the connecting part 102 rests against the intermediate part 72 to immobilize the latter.

The solenoid 104 has an axially movable actuating part 106, which travels to the left in FIG. 4 when the magnet 104 is energized. The actuating part 106, which is displaceably guided in the connecting part 102, extends into a chamber 108 formed in the connecting part 102, which forms a continuation of the adjoining compensating chamber 92 in the intermediate part 72. The actuating part 106 is used to control a servo cone or servo control blocker 110, for which a valve seat 112 is formed on the intermediate part 72. Valve seat 112 is located on the intermediate part 72 in front of the access to the second orifice 90, i.e. it can be closed by the servo cone 110. The free end of the actuating part 106 rests on a pressure piece 114 located in chamber 108. One end of a second compression spring 116 rests on pressure plate 114. The other end of spring 116 rests against a pressure disk 118, which forms a rear part of the valve cone 110 and which has an enlarged diameter. A third compression spring 120 is inserted between the pressure plate 118 and the intermediate part 72. The spring force of spring 120 is lower than that of the other second compression spring 116 resting on the pressure plate 118, for resetting the servo cone 110, i.e. lifting it off the valve seat 112 when the solenoid 104 is not energized.

In this arrangement, the second orifice 90 can be closed by the servo cone 110 when the solenoid 104 is actuated or opened by the restoring force of the third compression spring 120 when the solenoid 104 is not actuated. When the second orifice 90 is closed by the solenoid 104, the servo oil is prevented from flowing, i.e. the regulating piston 68 closes the connection between the fluid inlet 44 and the fluid outlet 46. When used as a pressure compensator or pressure maintenance-type component 38 with the hoist damper 14, as shown in FIG. 3, the valve not only takes over the function of the compensator or pressure maintenance-type component 38 when the hoist damper 14 is activated, but also, when the hoist damper 14 is deactivated. The valve additionally takes over the function of the switching valve 50 of FIG. 1, which blocks the loading line 48, and replaces the former.

While various embodiment have been chosen to illustrate the invention, it will be understood by those skilled in the art that various changes and modifications can be made therein without departing from the scope of the invention as defined in the claims.

The invention claimed is:

1. A valve usable as a pressure compensator in hydraulically actuated hoists, the valve comprising:

a valve housing a control port, fluid inlet port and a fluid outlet port;

a regulating piston longitudinally displaceably in the valve housing against biasing of an energy store between a first position connecting the fluid inlet port and the fluid outlet port in fluid communication and a second position blocking fluid communication of the fluid inlet port and the fluid outlet port by a control pressure existing at the control port;

a first orifice in the regulating piston connecting the control port to a receiving space containing the energy store in fluid communication; and a second orifice in an intermediate part in the valve housing connecting the receiving space to a compensating chamber in fluid communication, the compensating chamber being connected in fluid communication to the fluid outlet port without being via a tank.

2. A valve according to claim 1 wherein the energy store is a compression spring.

3. A valve according to claim 1 wherein the second orifice is closable by a servo control blocker.

4. A valve according to claim 3 wherein the servo control blocker is actuated by a solenoid.

5. A valve according to claim 4 wherein the servo control blocker comprises a servo cone interacting with a valve seat on the intermediate part and being engaged by two blocker energy stores acting in and against a direction of action of the solenoid.

6. A valve according to claim 5 wherein the two blocker energy stores comprise compression springs.

7. A valve according to claim 5 wherein an actuating part of the solenoid is guided in a connecting part of the solenoid connecting the solenoid to the valve housing, the connecting part receiving one of the two blocker energy stores and being connected to the intermediate part.

8. A valve according to claim 7 wherein the intermediate part and the connecting part are stationarily mounted in the valve housing.

9. A valve according to claim 1 wherein the compensating chamber is at least partially in the intermediate part establishing a fluid communication connection to a collecting chamber as a further part of the compensating chamber, the compensating chamber being permanently connected in a fluid communication to the fluid outlet port in the valve housing via a fluid-conveying passageway.

10. A valve according to claim 1 wherein the regulating piston is hollow in the area adjacent the control port and in an area adjacent the energy store; and the first orifice is in a piece threaded in the regulating piston and comprises two cavities permanently connected to each other in fluid communication.

11. A valve according to claim 1 wherein the regulating piston comprises a stop part on a side of the regulating piston facing the intermediate part, the stop part being able to contact the valve housing and intermediate part in first and second stop positions, respectively, of the regulating piston.

12. A valve according to claim 11 wherein the control port extends in an axial direction into the valve housing;

the fluid inlet port and the fluid outlet port extend in radial directions through the valve housing; and the regulating pistons and the valve housing define an annular space on an outer circumference of the regulating piston, the annular space completely transverses the fluid outlet port in the second stop position of the regulating piston.

13. A valve according to claim 1 wherein the first and second orifices are throttles.

14. A hydraulically activated hoist, comprising:

a hydraulic power cylinder having first and second working chambers a pressure compensator valve including a valve housing a control port, fluid inlet port and a fluid outlet port, a regulating piston longitudinally displaceably in the valve housing against biasing of an energy store between a first position connecting the fluid inlet port and the fluid outlet port in fluid communication and a second position blocking fluid communication of the fluid inlet port and the fluid outlet port by a control pressure existing at the control port, a first orifice in the regulating piston connecting the control port to a receiving space containing the energy store in fluid communication, and a second orifice in an intermediate part in the valve housing connecting the receiving space to a compensating chamber in fluid communication, the compensating chamber being connected in fluid communication to the fluid outlet port without being via a tank, the control port being connected to the first working chamber in fluid communication;

a pressure supply source connected in fluid communication to the fluid inlet port; and a pressure accumulator connected in fluid communication to the fluid outlet port.

15. A hydraulically actuated hoist according to claim 14 wherein the first working chamber is integrated into a fluid communication connection between the pressure compensator valve and the pressure accumulator via a first shut-off valve; and the second working chamber is connected in fluid communication to a return line to a tank via a second shut-off valve.

16. A hydraulically actuated hoist according to claim 14 wherein the regulating piston comprises a stop part on a side of the regulating piston facing the intermediate part, the stop part being able to contact the valve housing and intermediate part in first and second stop positions, respectively, of the regulating piston.

17. A hydraulically actuated hoist according to claim 16 wherein the control port extends in an axial direction into the valve housing;

the fluid inlet port and the fluid outlet port extend in radial directions through the valve housing; and the regulating piston and the valve housing define an annular space on an outer circumference of the regulating piston, the annular space completely transverses the fluid outlet port in the second stop position of the regulating piston.

18. A valve usable as a pressure compensator in a hydraulically actuated hoist, the valve comprising:

a valve housing a control port, a fluid inlet port, a fluid outlet port and a longitudinal axis;

a regulating piston axially movable in the valve housing along the longitudinal axis against a biasing of an energy store between open positions connecting in fluid communication to the fluid inlet port and the fluid outlet port and a closed position blocking fluid communication between the fluid inlet port and the fluid outlet port by a control pressure existing at the control port;

a receiving space in the regulating piston containing the energy store, the retaining space being in fluid communication with the control port;

an intermediate part in the valve housing, the intermediate part having a compensating chamber connected in fluid communication to the receiving space and to the fluid outlet port; and a stop part on a side of the regulating piston facing the intermediate part, the stop part contacting the valve housing in the closed position and the intermediate part in a fully open position of the regulating position.

19. A valve according to claim 17 wherein the control port extends in an axial direction into the valve housing;

the fluid inlet port and the fluid outlet port extend in radial directions through the valve housing; and the regulating piston and the valve housing define an annular space on an outer circumference of the regulating piston, the annular space completely transverses the fluid outlet port in the fully open position of the regulating piston.

* * * * *